United States Patent [19]

Belousofsky

[11] 4,158,082

[45] Jun. 12, 1979

[54] LAMINATED FERRO-CEMENT STRUCTURES AND METHOD OF FABRICATION

[76] Inventor: Bruce Belousofsky, R.D. #4, Box 463A, Sewell, N.J. 08080

[21] Appl. No.: 819,360

[22] Filed: Jul. 27, 1977

[51] Int. Cl.[2] ..... B63B 5/24; B63B 5/20; B32B 27/38

[52] U.S. Cl. ..... 428/256; 9/6 P; 9/6 R; 9/6.5; 264/34; 264/35; 264/256; 264/308; 264/DIG. 57; 428/99; 428/102; 428/285; 428/287; 428/415; 428/416

[58] Field of Search ..... 9/6 P, 6 R, 6.5; 264/34, 35, 219, 256, 275, 308, DIG. 57; 428/99, 102, 110, 133, 256, 285, 287, 415, 416

[56] References Cited

U.S. PATENT DOCUMENTS

| | | | |
|---|---|---|---|
| 2,758,321 | 8/1956 | Westfall | 9/6 P |
| 3,652,755 | 3/1972 | Iorns et al. | 264/219 |
| 3,705,228 | 12/1972 | Mattingly | 264/308 X |
| 3,773,581 | 11/1973 | Stanley | 9/6 P |
| 3,811,141 | 5/1974 | Stoeberl | 9/6 P |
| 4,065,820 | 1/1978 | Starratt | 9/6 P |
| 4,089,783 | 5/1978 | Holyoak | 428/256 |
| 4,090,336 | 5/1978 | Carroll | 428/256 X |
| 4,099,280 | 7/1978 | Hoppe et al. | 9/6 P |
| 4,119,748 | 10/1978 | Verbauwhede | 428/285 |

*Primary Examiner*—Harold Ansher
*Attorney, Agent, or Firm*—Morton C. Jacobs

[57] ABSTRACT

Structures such as the shell of a boat are formed in a ferro-cement laminate composed of a fiber glass reinforced skin and ferro-cement with a coupling between the fiber glass layer and the ferro-cement that consists of fabric connector tapes that are bonded to the fiber glass and that have projecting wires which are secured to the armature wires of the ferro-cement. The structure is fabricated with the molding of the fiber glass skin with the connector tapes bonded thereto and the connector wires projecting therefrom. Thereafter, the ferro-cement armature is fitted within the molded shell and the connector wires secured thereto, and the cement is poured and shaped. An epoxy adhesive bonds wet cement to the cured fiber glass resin impregnant and armature wires and also fills any voids in the poured cement.

15 Claims, 5 Drawing Figures

LAMINATED FERRO-CEMENT STRUCTURES AND METHOD OF FABRICATION

BACKGROUND OF THE INVENTION

This invention relates to molded reinforced cement structures, and particularly to ferro-cement boat and other marine structures.

Ferro-cement (a rich concrete mortar highly reinforced with steel wire and rods) is used in building boats by means of open mold plastering and by male and female molding. In the open mold plastering, the desired shape of marine structure is formed by building appropriate frames which are then covered with wire mesh and rod reinforcement to form an armature that is wire tied; the compact armature is plastered with a rich dry cement recipe and finished from the outside. This open mold plastering method requires considerable care in the formation of a soundly structured shape and in the tying of the armature. The plastering also requires considerable hand labor, and the application of protective or cosmetic finishes is difficult.

In male molding, the reinforcing wire and rod are attached to the male mold, usually by staples, and the mold is built in inverted form which is destroyed after plastering, and the plaster is finished smooth from the outside with some difficulty. Because of the destruction of the male mold, it is appropriate more for one-of-a-kind construction but not for mass production.

Female molding is described in the Iorns U.S. Pat. No. 3,652,755 in which successive layers of cementitious material are applied to a female mold with the reinforcing metal being pressed into the second and successive layers. This method is difficult to use because the reinforcement cannot be uniformly and evenly dispersed as well as compacted and joined.

The female mold process is also described in the Mattingly U.S. Pat. No. 3,705,228: In a fiberglass mold, an unreinforced outer resinous coat is applied, to which coat chicken-wire mesh is attached by means of an epoxy adhesive; part of the mesh projects from the adhesive so that tying wires may be joined thereto and used for tying down the ferro-cement reinforcement armature. The process described in this patent requires the adhering of the metal chicken wire to an outer skin of epoxy resin which would be brittle and weak in tension. The chicken wire would be difficult to form to curved or flat surfaces, and it would be difficult to thread tying wires to the projected portions of the chicken-wire mesh as well as to align the armature wires and rods thereto.

Ferro-cement, as used herein, calls for a "specific surface ratio" of the area of the armature wire used as reinforcement to the volume of the cement composite; where this ratio is between about 2 and 3 $cm.^{-1}$, the material is generally considered to be ferro-cement, while a ratio below 0.5 $cm.^{-1}$ indicates reinforced concrete.

SUMMARY OF THE INVENTION

It is among the objects of this invention to provide a new and improved molded thin shell cement structure.

Another object is to provide a molded thin shell cement structure of high strength.

Another object is to provide a molded thin shell structure of high quality and external appeal as well as versatility in molded shape and adaptable for mass production.

Another object is to provide a new and improved molded thin shell cement structure having an outer impervious surface for protecting the cement structure, and which is impact-resistant.

Another object is to provide a new and improved molded thin shell cement structure composed of outer composite laminate and inner composite laminate, both reinforced and mechanically tied together.

Another object is to provide a new and improved method of manufacture of molded thin shell cement structures.

Another object is to provide a new and improved method of manufacturing molded thin shell cement structures which lends itself to mass production techniques.

Another object is to provide a new and improved method of manufacture of molded thin shell cement structures to which high quality control methods may be applied.

Another object is to provide a new and improved method of manufacture of molded thin shell cement structures having inner and outer composite laminates and for effectively tying the laminates together and which is effective for various configurations of reinforcement in each laminate.

In accordance with one embodiment of this invention, a laminated shell cement structure is fabricated with a resinous outer coat having a cloth reinforcement bonded thereto. An inner laminated structure includes a layer of cementitious material reinforced by a wire armature. The outer coat and inner laminate are mechanically coupled by a plurality of devices, each including cloth and at least one U-shaped tying wire secured directly to the coupling cloth by means of the intermediate web of the wire. The coupling devices are located between the outer coat and the armature with the coupling cloth bonded to the outer coat and reinforcement, and the tying wires tied to the armature of the inner laminate.

In one particular form of the invention, the cloth reinforcement and the coupling cloth are both fiberglass, and the resinous outer coat employs a fiberglass gel.

A ferro-cement molding process using a female mold in accordance with this invention comprises the steps of applying a resinous layer to the mold along with a cloth reinforcement and curing that reinforced layer. Thereafter coupling devices are applied to the reinforced layer, which devices include lengths of cloth having tying wires secured thereto and projecting outwardly from the cloth. The coupling cloth is bonded to the reinforced layer. Thereafter a metal reinforcement armature is applied over the reinforced layer and the projecting tying wires, and the latter wires are tied firmly to the armature. The cementitious material can then be applied to the armature and cured.

In particular forms of the invention, the coupling devices are set down with strips of cloth in configurations planned and associated with the configurations of the wire and rods forming the armature so that the projecting tying wires are located to have a mating relation to the armature wires and rods so that they can be readily tied thereto.

An epoxy resin is used to lubricate the cementing and to bond the cement to the fiberglass laminate and armature.

BRIEF DESCRIPTION OF THE DRAWINGS

The foregoing and other objects of this invention, as well as the various features thereof, will become more apparent from the following description when read together with the accompanying drawings, in which.

In the drawing, corresponding parts are referenced throughout by similar numerals.

DESCRIPTION OF A SPECIFIC EMBODIMENT

Figure 1:
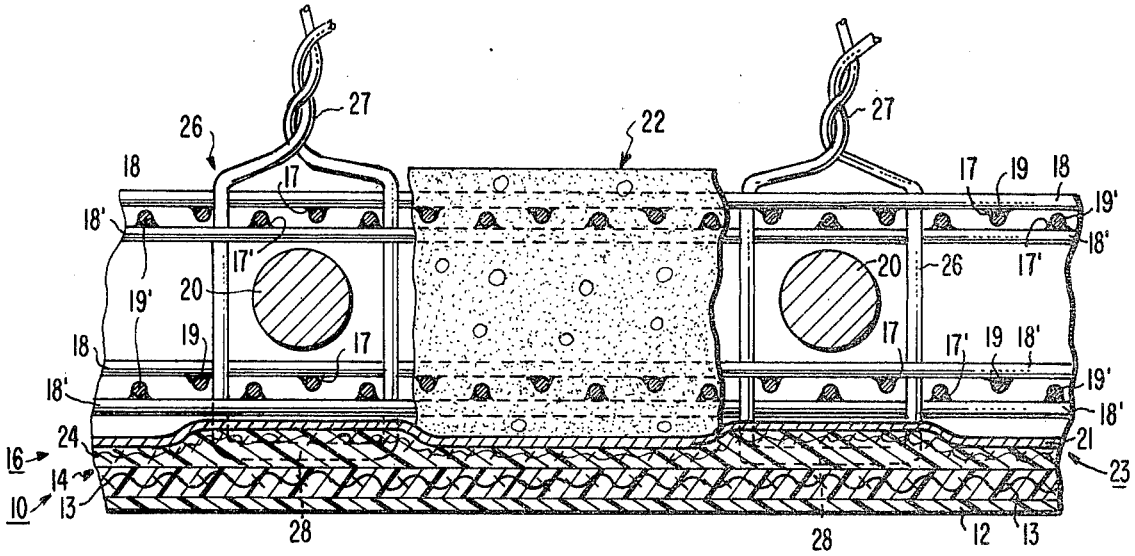
FIG. 1 is a side sectional view in simplified and idealized form and with parts omitted of a particular laminated structure embodying this invention.
Figure 2:
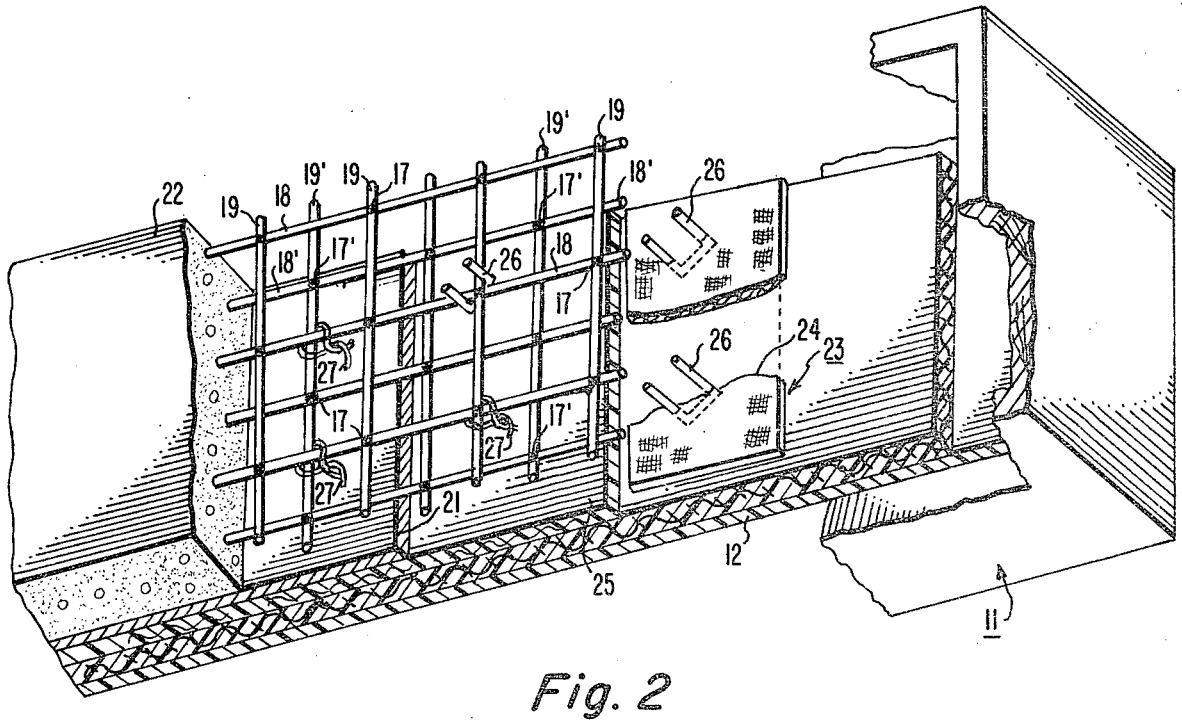
FIG. 2 is a top perspective view of a section of ferro-cement structure embodying this invention illustrating the assembled structure at various stages of formation, and the process of forming the structure in a mold.

As shown in FIGS. 1 and 2, a ferro-cement structure embodying this invention includes an outer reinforced laminate 10. The latter has a fiberglass-reinforced gel outer coat 12 that is formed in a female mold 11, which may be the conventional mold of a fiberglass boat. The thickness of this layer may be typically 15 to 20 mils. A reinforcement layer 13 is applied to the outer gel coat 12, which reinforcement may take the form of fiberglass matt, cloth or woven roving. This reinforcement 13 is bonded by means of a suitable resin (e.g., a polyester resin) 14 to the outer gel coat 12.

Secured to this outer laminate 10 is a reinforced inner ferro-cement structure or laminate 16 composed of a steel armature formed by longitudinal and transverse wires 18 and 19 (e.g., formed as a mesh) and suitable rods 20 (illustrated in FIG. 1 only as running transversely). This armature 18, 19 and 20 may be assembled in any desired form (e.g., the wires 18, 19 and 18', 19' may be respectively welded at points 17 and 17' of intersection) depending upon the requirements of the structure being fabricated and following well-known design arrangements used in fabricating ferro-cement structures. The larger rods 20 are designed, for example, to provide the needed strength for a long structure (e.g., a 30-foot boat) rather than as part of the ferro-cement reinforcement. The cement 22 is applied on that armature 18, 19 and 20; a coating 21 of epoxy resin is applied to the inner laminate 10 and to the wires 18, 19 and rods 20 for forming an interface between the cement and the inner laminate and armature.

The outer reinforced laminate 10 is mechanically coupled to the inner reinforced cementitious structure 16 by means of a plurality of quill strips 23. These coupling strips 23 are formed as strips of fiberglass tape 24 having one or more U-shaped steel tying wires 26 projecting therefrom with the web 28 of the wire set on the opposite side of the tape 24 from the projecting tying quills 26. The tape 24 of the quill strip 23 is bonded by means of a polyester resin 25 to the reinforcement layer 13, 14 of the fiberglass reinforced outer laminate 10. Thereby the tapes 24 of the quill strips 23 are enveloped by a brittle matrix and are effectively integrated as part of the reinforced outer laminate 10. The quills or tying wires 26 project outwardly from the outer laminate to engage the mesh wires 18 and 19 of the armature 16 as well as any larger structural rods 20 that are employed. The steel tying wires 26 are firmly secured to all of the elements of the armature by tightly twisted ends 27 around the armature wires 18 and 19. The web 28 of the quill element is embedded within the reinforced outer laminate 10 and strongly retained therein by the relatively wide strip of fiberglass tape 24 extending several times the dimension of that web 28. Thus the bonding of the quill coupling strips 23 to the outer laminate is by means of the strength of the fiberglass reinforcement and the resinous bonding, and the coupling to the armature is by means of the firmly tied quill wires 26. A high strength intercoupling is formed in the embedded reinforced fiberglass strip 24 and web 28 of the tying wire.

This structure has the advantages of the outer reinforced laminate of fiberglass and the advantages of the inner cementitious ferro-cement structure 16. These two structures are integrally secured and coupled to each other so that the integral structure can be used for a wide variety of purposes including that of boats, barges and other marine structures as well as for other ferro-cement applications including decorative building panels, storage tanks whose molded similar sections can be assembled in the field, and for complete structures such as dome sections and the like which can be molded in a factory and assembled on site.

The coupling of the fiberglass laminate to the ferro-cement structure (or vice versa) is provided by a device which has separate elements which serve to reinforce respectively the fiberglass laminate and the armature of the cement structure. These two elements of the coupling device are themselves interengaged and formed in a strong connection which is enhanced by the reinforcing bonding of the fiberglass tape in the fiberglass laminate. Thus, the tying wires 26 for the reinforcing armature of the ferro-cement structure are anchored to the fiberglass laminate 10 by the fiberglass strips 24, which in turn reinforce the fiberglass laminate.

In the fabrication process of the outer laminate 10, a conventional fiberglass mold 11 (FIG. 2) is prepared in a normal manner, and its molding surface is coated with wax and polyvinyl alcohol or other acceptable parting agents for easy release of the molded object from the mold. A gelcoat 12 of desired thickness (e.g., 20–30 mils) and color is applied to the prepared mold surface and then cured. The unreinforced gelcoat 12 is then reinforced with a desired thickness of fiberglass matt, cloth or fiberglass woven roving 13 which varies for different strengths of fiberglass laminate. This reinforcement 13 is bonded with polyester resin 14 (e.g., the same as that used for the gelcoat 12) to the previously applied gelcoat 12. The desired number of reinforced layers (which varies with the application of the structure being molded) of cloth or roving 13 and resin 14 are so applied and cured. Up to this point the described method is generally similar to that of conventional structure molding of fiber-reinforced plastic.

The quill strips 23 are prepared using strips 24 of fiberglass tape with U-shaped tying wires 26 stuck through at right angles to the surface of the tape. The tying wires 26 have a predetermined spacing (e.g., 3-inch spacing for flat sections or closer for curved) and the distance between the parallel sides of the U-shaped wire is desirably at least half the wire spacing of the chosen mesh reinforcement 18, 19. The quill strips are bonded by resin into the previously cured coats 12, 13,

14 to form another reinforced layer of laminate 10. The tying wires 26 run in parallel paths, a predetermined space apart (e.g., along one side, from one end of the mold to the other end, and thence along the other side of the mold from end to end). The complete structure (including the joining seams of the molded structure) receives these quill strips, so that the reinforcing mesh that they tie down can be placed at random or non-aligned positions for good reinforcement dispersion and still achieve firm and tight retention.

The first layers of wire mesh reinforcement 18 and 19 are positioned over the quill-strip wires 26 and placed adjacent to the last-cured fiberglass-reinforced resinous layer 25 that is reinforced with the quill-strip tapes 24, so that the tying wires 26 protrude through the spaces in the mesh. A few of the tying wires may be tied into twisted ends 27 to fix the position of a first layer of mesh 18, 19. The wires 26 that are used are twisted, cut short and placed in a plane with the mesh reinforcement 18 and 19. Succeeding layers of mesh 18, 19 are then positioned over the tying wires 26 and placed adjacent to the previous mesh but not aligned—preferably offset to about half the mesh wire spacing; this arrangement is shown in FIG. 1 for mesh layers 18, 19 with welds 17 and for layers 18', 19' with welds 17'. This allows for uniformly spaced distribution of reinforcement in the cementitious laminate section 16. This second layer of wire mesh is also fixed in position by twisting a few other tying wires around it. Each succeeding set of these twisted wires is treated in the same manner as the first set. The remainder of the mesh required to properly reinforce a particular structure (and rods 20 where needed) may be then placed and tied into an integrated armature. If reinforcing rods are used in conjunction with the wire mesh, the quill strips and their tying wires are located and oriented to engage and tie those rods. Subsequent layers of mesh may be laced to the previously tied rods, which then serve as anchors for those subsequent mesh layers, or hog rings are used to securely fasten the subsequent mesh to the previously placed rods. The hog rings or lacing are used to tie the previously placed mesh reinforcement to the mesh placed after all the quill wires have been used. However, depending on the shape of the particular structure to be formed, all or most of the armature mesh may be secured with the tying wires of the quill tapes.

Figure 4:
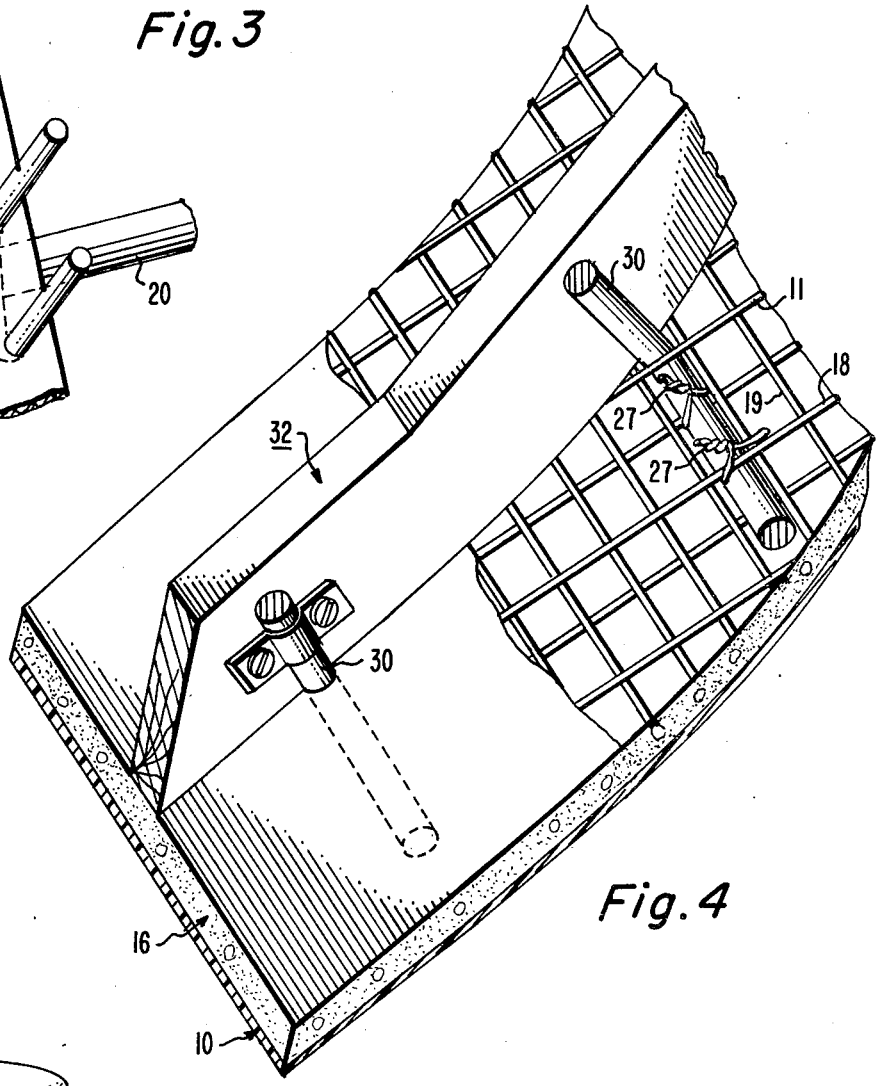
FIG. 4 is a perspective view of a section of a ferro-cement structure embodying this invention and connected to other structures.

During fabrication of the wire mesh, armature attachment tabs 30 (FIG. 4) for interior joiner work may be installed; e.g., tabs for interior motor mounts, transverse reinforcement webs and bulkheads 32—or rod armature for the reinforcement webs themselves. The tabs 30 are rods that are secured to the reinforcement mesh 18, 19 by means of twisted tying wires 27 (FIG. 4) in a manner similar to rods 20. The tabs 30, like rods 20, are normally placed in the middle of the total layers of wire mesh 18, 19.

When the armature is complete, plastering preparations may be made. That is, prior to plastering cementitious material on the armatures, a coating of an epoxy bonding agent 21 (not to scale) is applied to the exposed polyester layers of the outer laminate 10 and to the wire mesh. The epoxy is applied in that area of mesh that is to be cemented, by spraying or brushing, taking care to thoroughly wet out the exposed wire and polyester surfaces. This bonding agent has several purposes: 1. it provides a bond between the cementitious material and cured polyester (and, in sectional construction, between adjacent sections of cement); 2. it provides an improved bond between the cementitious material and the reinforcement; 3. it provides protection to the armature mesh (e.g., if galvanized) against electrolytic action in the wet cement; 4. it acts as a lubricant to ease cement penetration; and 5. it fills in interstices and voids in the cement.

While the epoxy bonding agent is still in a liquid state, cementitious material 22 is applied to the mesh. The cement is pushed into the mesh to improve penetration. Since the mold is in a down-hand position, there is gravitational flow, and the penetration is eased by the epoxy liquid acting as a lubricant. As the cement is pushed through the mesh it should be worked from all directional attitudes to penetrate the mesh. To insure mesh envelopment as the cement 22 approaches the cured polyester, the epoxy bonding agent forms an interface and by hydraulic action, it fills all remaining voids between the cement and the polyester. The agent also fills the open voids in the outer periphery of the cement (the bulk of the epoxy being displaced by the cement into the voids) and effects a good bond to the outer laminate 10.

The cement is applied until the armature is penetrated and the cement just covers the top layer of mesh reinforcement. This top layer of mesh is used as a cement thickness guide. Excesses of cement may be broomed off leaving a good surface for paint adhesion. The cemented area is cured, preferably with steam as known in the art, which shortens the cure time to twenty-four hours and other areas may be cemented thereafter. The cement used may be of a Portland type cement with a graded sand mixture. The water used must be clean potable water. The water to cement ratio may be 0.4 by way of example and the sand to cement ratio may be 2, both by weight.

Various cement mixtures are available and with this invention any acceptable combinations may be used. Normal Portland cements may be used and, as known in the art, combinations of cement, sand, water, and additives may be used to achieve the optimum strength and workability for different types of structures. Various polymer cements have been developed which yield high strength and may be used in place of the Portland cement. These may be used directly in the laminate with or without the epoxy bonding agent.

After the completed hull is cured it may be removed from the mold. For smaller hulls, if lifting equipment is available, the structure may be lifted directly out of the mold. For larger structures or a recurved structure, a split mold is recommended. Normal finishing may be then commenced in the structure.

This process uses a conventional fiberglass boat mold, with no changes or alterations required, because the mold receives the same molding material surface that it receives in molding conventional fiber-reinforced polyester. This has a production advantage in that the same mold can be used for a conventional fiberglass boat as for this ferro-cement laminated boat providing the dimensions are proper. Thus, a manufacturer can produce two types of structures from the same mold.

The outer laminate 10 for marine structures such as a boat provides a strong, effective outer finish that is of high quality including that of a pleasing finish. A smooth outer surface of low skin friction resistance is repeatedly molded in the same way as the molding of fiberglass boats generally.

No time consuming surface treatment and finishing is required, which eliminates much time consuming labor.

The reinforced laminate 10 provides an impervious skin to eliminate water leakage through the microcracks that occur under certain expected loads. If mocrocracks larger than 50-microns occur from unexpected loads or damage, the fiber-reinforced laminate 10 tends to protect the wire reinforcing from unexpected loads or damage, and from corrosive degradation by preventing excessive ingress of water.

In some environments, corrosion of the wire reinforcement can occur without cracking, especially with a thin layer of cement over the wire. Since ungalvanized wire is stronger in ultimate tensile yield, it is preferred; however, without the corrosion protection, it is subject to faster degradation. The impermeable laminate skin 10 protects any type of wire from this attack. Certain cementitious materials are as well subject to sulfate attack and the laminate 10 protects both the cement and the reinforcement wire. Sulfate resistant cement is available though not universally and the gelcoat laminate 10 eliminates the need of them thereby reducing cost.

The coupling cloth 24 and the other reinforcing layers of fiberglass cloth, matt or roving of the laminate 10 provide an improved impact resistant surface on the impact side of the ferro-cement; therefore the poor impact resistance inherent in the ferro-cement can be substantially compensated. The fiberglass medium acts to modify the stress wave induced by impact. As the normal forces of an impact are transmitted through the layers of fiberglass and epoxy, the reflected waves are modified, and the components of the force are absorbed by the fine fiber reinforcement of the outer laminate 10.

The mechanical tying method transversely strengthens the structure. As explained above, the quill tie wires stuck through the fiberglass tape couple the reinforcement of the fiberglass reinforced polyester laminate 10 to the reinforcement of the ferro-cement making this laminate material inherently stronger. This mechanical tying action reduces spalling of the cement due to impact, and gives the total laminate more strength; e.g., the ties are part of the reinforcing armature 18, 19. These ties as well aid in the construction process by holding subsequent layers of reinforcement and rod in place during reinforcement lay-up and by compacting the reinforcement. Fewer armature ties are required due to the fact that the mold below the cement supports the final form, and no sagging of this wire reinforcement can occur due to that mold support.

The placement of the armature reinforcement prior to the addition of cementitious material is important, for the ultimate strength of a ferro-cement material is dependent on the degree of uniformity in the dispersal of reinforcement armature, especially the wire mesh. The exact alignment and distribution of mesh can only be performed prior to the application of cementitious material; the quill strips used in this invention enable great flexibility in assembling the armature mesh. Furthermore, the invention allows for the use of high tensile strength material in reinforcement mesh and rods which increases the ultimate strength and reduces the overall size. This high tensile material can be applied since it is part of the reinforcement armature layers that are pulled down by the coupling wires 26 to conform those layers to the shape of the molded laminate 10, where they are tied down and is part of each succeeding armature or rod layer that is tied against the reinforcement already formed. Thereby misalignments of the armature are avoided which, in prior female mold methods, could leave large areas of unreinforced cementitious material, thereby weakening the material and making marine structures unsafe. The present invention allows for complete inspection of the reinforcement armature prior to placing cementitious material assuring uniform reinforcement and allowing for marine or other classification society inspection.

The completed reinforcement armature of the desired lay up of wire and rods also serves as a guide for cement placement, and thereby eliminates excessive build up of unreinforced cementitious material; for when plastering is performed, the plaster should end just above the last layer of reinforcement.

The invention further allows another bonding and strengthening medium (such as epoxy) to be applied between the interface of the fiberglass and the cementitious materials. That is, after the complete armature is wired into the mold by use of the quill wires, the area to be cemented is coated with an epoxy bonding agent that cures in the presence of moisture or wet cement. Moreover, this epoxy, before curing, acts like a lubricant to ease cement penetration of the nested wire armature, so that much dryer mixes of cement can be effectively used, thereby to increase the laminate strength. The epoxy flows and is displaced by the cement to fill in voids in that cement as it sets and, as it flows, indicates to the operator the regions of cement penetration.

In the fabrication of structures embodying this invention, the gelcoat 12 used is a standard polyester gelcoat of a type which is available premixed in various colors, and is thioxytropic. Rapid cure is established by the addition of 1-2% methyl ethyl ketone peroxide, depending on the ambient working temperatures. This gelcoat is preferably applied by either spray or roller. Two coats have been used, the second coat for bonding with the reinforcement fiber. As the desired thickness of two or more layers of gelcoat get tacky, ¾ oz./sq. ft. chopped fiberglass fiber in a matt is layed into the gelcoat; 1.5 oz./sq.ft. matt has also been used successfully. Any layer of fiberglass reinforcement is thoroughly wetted with polyester resin catalyzed with 1% methyl ethyl ketone peroxide and bonded to the tacky gelcoat. The matt is followed by one layer of 24 oz./sq.yd. woven roving, which is wetted out using polyester resin catalyzed with 1% methyl ethyl ketone peroxide. On structures that have been produced, 10 ounce woven cloth was used in lieu of the woven roving, but woven roving will generally yield a stronger laminate due to the increased percentage of fiberglass reinforcement. This fiberglass work is preferably done in sequential layers prior to any one layer curing. If a curing step in the process is unavoidable, such as between chop matt application and woven roving application, the surface should be rough sanded or scarified to insure a good bond. After all the above glass work is cured the final layer is scarified. The dust is removed. The quill strips are then resined into the laminate.

In the fabricated structures, 2-inch wide fiberglass tape of 10 oz./sq.yd. weight was used for the coupling cloth. The quill wires have been formed from 20-gauge black annealed wire. Successive layers of wire mesh 18, 19 may be offset; e.g., by about a half wire spacing to increase the effective reinforcement (shown in FIG. 1), and the positions of the quill wires 26 should be planned to coincide with the particular layer of mesh and rod to be tied. The width of the quill wire web 28 should be greater or less than half the wire reinforcement spacing but preferably not equal to exactly half or a whole-wire spacing. The wire sides 26 should be at about a right angle to the bottom web 28 formed in a tight bending curve. The wire sides 26 should be straight and about four times as long as the expected thickness of the overall mesh to provide sufficient wire for twisting but with adequate stiffness, and to allow a number of large sheets of wire mesh to be placed over the upright wire quills 26.

In fabricated structures, the wire ties 26 were about two inches apart for smaller structures, about three inches apart for larger ones. The wires are simply pushed through the cloth tape 24 in between the warp and the woof filaments. The tapes, with the quills, were placed onto the polyester layer 14 previously layed down, and then resined in before the prior placed laminate 14 had cured; however, in large scale fabrication this will be difficult due to the pot-life of the resin. Therefore, in large scale, all polyester laminate will ordinarily be left to cure, the surface scarified, and then the quill tape resined to this cured surface. In small and larger structures that have been fabricated, the resin applied on top of the cloth of the quill strips wets out the fibers easily. Some air bubbles do form around the area of the quill wire, but they can be removed by pushing on them with an application brush. Some of the quill wires rotate and fall down during this operation, but after cure the wires 26 are readily freed and bent up (from the web 28 held firmly in the cured resin below the cloth) to project at right angles to the surface of the polyester laminate.

The wire reinforcement used in fabrication is precut to properly fit into the mold. When the mold has sharp sloped or curved sides, a quill strip is placed at the junction of the sides of the structure or at any point of substantial change in slope to pull the armature tightly into the mold at those important points. In production, extra ties may be placed in certain areas to tie each layer of mesh as it is applied. The mesh used in fabricated structures was ½ inch, 19-gauge, steel welded, galvanized mesh. To avoid any hydrogen bubble formation in production, ungalvanized wire should be used. This hydrogen formation is a reaction between the black annealed wire and the galvanizing zinc in the presence of calcium cement. It is limited, though, due to the precense of the epoxy coating.

In one structure, four layers of mesh were laid into the mold with the wires of each successive layer offset from the preceding layer to half the preceding layer's mesh spacing. The pairs of layers were interspersed so two layers of two-wire thick mesh make a three wire thickness, as shown in FIG. 2. That is, the parallel woofs 18 were interspersed to be in substantially the same plane, and the warps 19 of the two mesh layers were positioned in different planes, above and below the woofs, respectively. Mesh layers were placed down upon the quills and the ties were formed, starting from the center to push the rolls out of the mesh. After twisting, the quills were cut back to about ¼ to ⅜ inch long and pushed back into the reinforcement almost level to provide a good guide of the level for cement placement due to the slight extension of the twisted quill ends 27 above the wire mesh.

A suitable epoxy resin is the diglycidyl ether of bisphenol A, which is a liquid thermosetting resin having a Brookfield viscosity of about 10,000 to 16,000 centipoise at a temperature of about 185 to 200. A suitable bisphenol A diglycidyl ether of this type is marketed by the Celanese Coatings Company under the trademark Epi-Rez 510. In general, any epoxy used should preferably provide a stronger bond of the polyester laminate to the cement than that within the polyester laminate itself. The epoxy must as well cure under moist or wet conditions. A wide variety of catalysts and reactive hardeners are known that cure or harden epoxy resins. While a number of different agents can be employed to cure the epoxy resins employed in the compositions of this invention, the reactive amine-type hardeners are preferred. A particularly preferred hardener is an admixture of a reactive amido-amine such as dicyandiamide and a high reactive modified amine converter. A suitable hardening agent of this type is marketed by the Celanese Coatings Company under the trademark Epi-Cure 872. The preferred hardening agent is added to the epoxy resin in the proportions of about 0.35 parts of hardening agent per part of resin. The minimum coverage of the Celanese mixture above was found to be 1.23 ml./in.$^2$ for four layers of mesh. This provided excellent bonding and good penetration lubrication. Different coverages will be dictated by different armatures.

Figure 3:
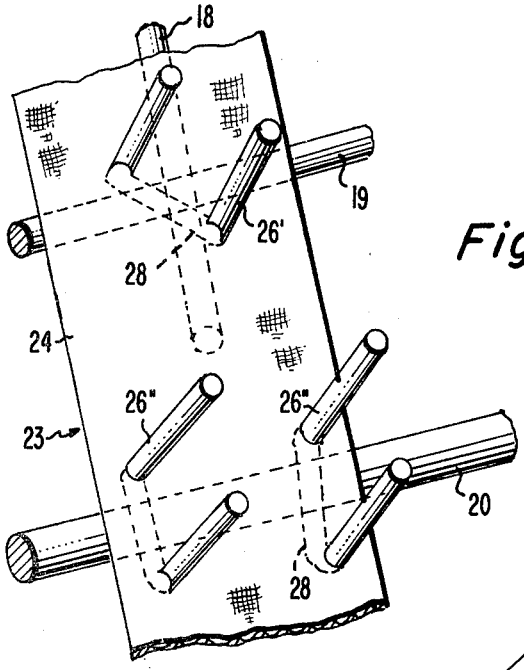
FIG. 3 is a perspective view of a coupling device embodying this invention and used in the structures of FIGS. 1 and 2.

For larger structures, reinforcement armatures are generally made of two components; mesh and rod reinforcement. The mesh is preferably ½ inch×½ inch, 19 guage, welded, ungalvanized steel mesh. The rods' size, range from ⅛ inch to ¼ inch and have tensile strengths of up to 130,000 psi. For two component reinforcement armature (mesh and rods) two quill positions on the fiberglass tape are utilized, each for its particular component. The quill material and the process for multiple component armatures is the same as previously explained. The exceptions are those that are dictated by the reinforcement chosen. For example, where the armature consists of two layers of mesh, one layer of ⅛ inch rod spaced three inches apart, and then another two layers of mesh (see FIG. 1), two different quill-wire orientations 26' and 26'' (FIG. 3) are used on the quill strip, one for the intersecting mesh wires 18, 19, the other for the rods 20 (or also the mesh wires 18, 19). The quills used for the rod wiring need only be on some of the quill strips; the spacing between the quills used for the rods is determined by the rod spacing, which is determined by the required structural strength. The quill spacing for the mesh is dependent on the rod spacing as well; the mesh quills on each strip are spaced the same as or twice the rod spacing, but offset from the rod quill positions. The spacing of the strips positions the mesh quills into a square orientation. The mesh quills 26' are oriented at 45° to the mesh wires to engage them at an intersection (FIG. 3), or at 90° to engage an individual wire. The orientation of the rod quills 26'' should be at right angles to the rod placement (see FIG. 3).

The distance between the rod quill sides should be:

$$S_r \geqq \tfrac{1}{2}Y + X \leqq Y$$

$S_r$=space between rod quill sides.
Y=mesh size.
X=wire size of mesh.

If the rod used is greater than $\tfrac{1}{2}Y+X$ then the rod will determine the rod quill side spacing; generally however, no rod larger than Y should be used. Larger rods tend to create larger masses of unreinforced cement, which just add weight not strength. Typically in ferro-cement laminates, the rod size is from ⅛ inch to ¼ inch, which conveniently fits in a spacing used with ½ inch wire mesh.

The space between the sides of the mesh quill should be:

$$S_m \geqq \sqrt{2}(Y/2+X) \leqq Y\sqrt{2}$$

$S_m$=spacing of the quill sides for mesh
Y=mesh size
Z=wire size of mesh

The quill wire should be about the same diameter as that of mesh wire. Using rod layups, far less quills are needed for structural integrity since the tying of the rod quills ties down the mesh below it. A spacing of twice the rod spacing for the mesh quills will often be sufficient.

The coupling cloth 24 is preferably part of the reinforcement of the outer laminate 10; however, tapes may also be used that have negligible reinforcing effect. Moreover, the coupling cloth 24 may be formed as the entire reinforcement of the outer layer.

Figure 5:
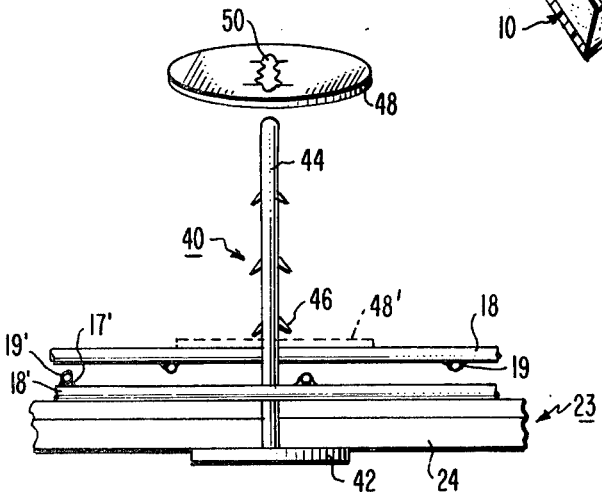
FIG. 5 is an enlarged front detailed view of a modified coupling device embodying this invention.

The quill wires may take other forms than the above-described U-shape. For example, a T-shape or L-shape coupling wire 40 (FIG. 5) may be used with the cross-bar 42 embedded and resined under the coupling tape 24 and the vertical bar projecting substantially at right angles to the tape 24. The vertical bar or leg 44 of the wire has bards 46 that receive a washer 48 with a latching opening 50 that wedges against the wire 44 and under the barbs 46. When washer 48 (shown in broken lines as washer 48') is latched in place, it firmly secures the mesh wire 18 or 19 to the coupling tape 24. The quill wires of this form of coupling device may also be U-shaped with the transverse web thereof embedded under the coupling tape and the pair of projecting legs both barbed to be fastened by a washer with a corresponding pair of latching openings.

Thus the above-described invention provides a molded thin shell ferro-cement structure of high strength and of high quality and pleasing external appearance. It is moldable in a wide variety of shapes under mass production techniques for a variety of applications such as the hull of a marine vessel. An outer impervious surface protects the ferro-cement laminate and resists impact which would tend to injure the ferro-cement laminate. The fabrication process makes high quality control methods available and is effective for producing a ferro-cement structure which has inner and outer composite laminates that are effectively reinforced and mechanically tied together.

It will be apparent to those skilled in the art from the foregoing illustrative description that this invention may be embodied in a variety of forms; thus the invention is not limited to the specific embodying details, but is of a scope set forth in the following claims.

What is claimed is:

1. A laminated shell structure comprising
a resinous outercoat section;
a reinforced cement section having a wire armature reinforcement and a layer of cementitious material formed on said armature reinforcement;
and a plurality of coupling devices, each including a cloth sheet and at least one metallic fastening device having an elongated projecting portion extending through said armature and a transverse portion, said fastening device being secured by means of said transverse portion directly to said coupling cloth sheet;
said coupling devices being connected to said outercoat and cement structure with said coupling cloth sheet bonded to said outercoat, said projecting portion secured to said wire armature at one side of said cloth sheet, and said transverse portion being secured between said cloth sheet and said outercoat at the other side of said cloth sheet.

2. A laminated shell structure as recited in claim 1, wherein said coupling cloth sheet is a reinforcement of said resinous outercoat section, whereby the outercoat section is an impact resistant surface for protecting said reinforced cement section.

3. A laminated shell structure as recited in claim 2, wherein said outercoat section includes a cloth reinforcement separate from said coupling cloth sheet.

4. A laminated shell structure as recited in claim 3, wherein said cloth sheet reinforcement and said coupling cloth are fiberglass, and said outercoat includes a fiberglass reinforced gel.

5. A laminated shell structure as recited in claim 1, wherein said coupling devices include spaced strips of fiberglass cloth sheet, and said fastening devices have the transverse portion thereof on the outercoat side of said cloth sheet and the projecting portion extending through said cloth sheet and projecting out at right angles from the cement section side thereof.

6. A laminated shell structure as recited in claim 5, wherein the projecting portion of said fastening devices include a plurality of projecting wires connected by said transverse portion.

7. A laminated shell structure as recited in claim 6, wherein said plurality of projecting wires are tied to said wire armature.

8. A laminated shell structure as recited in claim 5, wherein the projecting portion of said fastening devices includes first latching means and said coupling devices further include second mating latching means for securing said projecting portion to said wire armature.

9. A laminated shell structure as recited in claim 1, wherein said coupling devices further include an epoxy resinous interface between laminated outercoat and said cement structure.

10. A laminated shell structure as recited in claim 7, wherein said armature includes a plurality of layers of wire mesh, each of said layers being tied by different ones of said tying wires.

11. A laminated shell structure as recited in claim 10, wherein said armature includes structural rods located between said mesh layers and tied by different ones of said tying wires.

12. A laminated shell structure as recited in claim 1, wherein said shell structure is the hull of a marine vessel.

13. A ferro-cement molding process using a female mold comprising the steps of:
applying a resinous layer to said mold along with a cloth reinforcement and curing said reinforced layer;
applying coupling devices to said reinforced layer, which devices include lengths of cloth sheet having tying devices secured therethrough and projecting outwardly therefrom, and bonding said coupling cloth sheets to said reinforced layer;
applying a metal armature reinforcement over said reinforced layer and projecting tying devices, and tying said devices firmly to said armature;
applying cementitious material to said armature and curing said material.

14. A ferro-cement molding process as recited in claim 13, wherein said applying of the metal armature includes setting wire mesh over said projecting devices, and said step of applying coupling devices includes spacing said projecting devices to be located at intersections of the wires of said mesh for tying said mesh at said intersections.

15. A ferro-cement molding process as recited in claim 13, wherein said step of applying cementitious material includes applying an epoxy resinous material to said armature reinforcement for lubrication thereof during application of said cementitious material and for thereafter bonding said cementitious material to said armature reinforcement and to said resinous layer.

* * * * *